US005214024A

United States Patent [19]

Beck et al.

[11] Patent Number: 5,214,024

[45] Date of Patent: May 25, 1993

[54] THERMAL TRANSFER RECEIVER

[75] Inventors: Nicholas C. Beck; Paul A. Edwards, both of Essex; Richard A. Hann, Suffolk, all of England

[73] Assignee: Imperial Chemical Industries PLC, London, England

[21] Appl. No.: 555,264

[22] Filed: July 23, 1990

[30] Foreign Application Priority Data

Jul. 21, 1989 [GB] United Kingdom ..... 8916723
Nov. 9, 1989 [GB] United Kingdom ..... 8925280

[51] Int. Cl.[5] ..... B41M 5/035; B41M 5/26

[52] U.S. Cl. ..... 503/227; 428/195; 428/447; 428/913; 428/914

[58] Field of Search ..... 8/471; 428/195, 913, 428/914, 447; 503/227

[56] References Cited

U.S. PATENT DOCUMENTS 4,720,480 1/1988 Ito et al. ..... 503/227

4,778,782 10/1988 Ito et al. ..... 503/227

*Primary Examiner*—Bruce H. Hess

*Attorney, Agent, or Firm*—Cushman, Darby & Cushman

[57] ABSTRACT

A receiver sheet for dye-diffusion thermal transfer printing, comprising a sheet-like dielectric substrate supporting a layer of dye-receptive material on one side, has an antistatic treatment on both sides to improve handling. The antistatic treatment on the side supporting the receiver coat comprises a conductive undercoat located between the substrate and the layer of dye-receptive material. Effective conductive undercoat materials include a cross-linked organic polymer containing a plurality of ether linkages doped with an alkali metal salt to provide conductivity. The antistatic treatment on the other side is preferably incorporated into a heat resistant and/or low friction backcoat, but like that of the receiver side, could also be in the form of a conducting undercoat between the substrate and backcoat.

12 Claims, 1 Drawing Sheet

THERMAL TRANSFER RECEIVER

Figure 1:
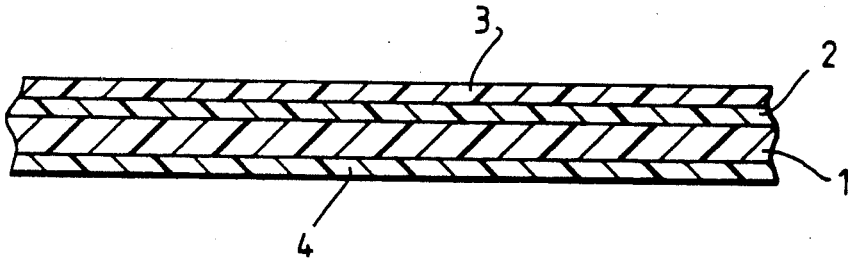

The invention relates to thermal transfer printing, and especially to receiver sheets of novel construction and their use in dye-diffusion thermal transfer printing.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°–220° C. for a period of 30–120 s, to transfer substantially all of the dye.

A more recent TTP process is one in which printer can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern already preformed on the dyesheet, a dyesheet for this process comprises a thin substrate supporting a dyecoat comprising a single dye or dye mixture (usually dispersed or dissolved in a binder) forming a continuous and uniform layer over an entire printing area of the dyesheet. Printing is effected by heating selected discrete areas of the dyesheet while the dyecoat is held against a dye-receptive surface, causing dye to transfer to the corresponding areas of the receptive surface. The shape of the pattern transferred is thus determined by the number and location of the discrete areas which are subjected to heating, and the depth of shade in any discrete area is determined by the period of time for which it is heated and the temperature reached. The transfer mechanism appears to be one of diffusion into the dye-receptive surface, and such a printing process has been referred to as dye-diffusion thermal transfer printing.

This process can give a monochrome print in a colour determined by the dye or dye-mixture used, but full colour prints can also be produced by printing with different coloured dyecoats sequentially in like manner. The latter may conveniently be provided as discrete uniform print-size areas, in a repeated sequence along the same dyesheet.

A typical receiver sheet comprises a sheet-like substrate supporting a receiver coat of a dye-receptive composition containing a material having an affinity for the dye molecules, and into which they can readily diffuse when the adjacent area of dyesheet is heated during printing. Such receiver coats are typically around 2–6 μm thick, and examples of suitable dye-receptive materials include saturated polyesters, preferably soluble in common solvents to enable them readily to be applied to the substrate as coating compositions and then dried to form the receiver coat.

Various sheet-like materials have been suggested for the substrate, including for example, cellulose fibre paper, thermoplastic films such as biaxially orientated polyehtyleneterephthalate film, plastic films voided to give them paper-like handling qualities (hence generally referred to as "synthetic paper"), and laminates of two or more such sheets. However, we have observed that some receiver sheets suffer from poor handling properties, this being especially noticeable when they are stored in packs of unused receiver sheets and stacks of prints made from them. Indeed, whenever individual sheets may be moved relative to adjacent sheets with which they are in contact, such sheets generally tend to stick together, rather than slide easily one sheet over another.

We have found such problems to be due to a number of different causes, but to be particularly prevalent in sheets based on thermoplastic films, synthetic papers and some cellulosic papers that are dielectric materials, i.e. materials that readily build up charges of static electricity on their exposed surfaces. We have found that it is possible to alleviate this particular problem by reducing the surface resistivities on both sides of the receiver sheet, generally to less than $1\times10^{13}$ Ω/square. On the reverse side remote from the receiver cost, antistatic agents can be incorporated into a backcoat (which may also provide other functions), but on the receiving side of the substrate we find that incorporation of antistatic agents into the receiver coat can also generate undesired side effects where release agents are present.

High resolution prints can be produced by dye-diffusion thermal transfer printing using appropriate printing equipment, such as the programmable thermal print head referred to above. A typical thermal print head has a row of tiny heaters which print six or more pixels per millimeter, generally with two heaters per pixel. The greater the density of pixels, the greater is the potential resolution, but as presently available printers can only print one row at a time, it is desirable to print them at high speed with short hot pulses, usually from near zero up to about 10 ms long, but even up to 15 ms in some printers, with each pixel temperature typically rising to about 350° C. during the longest pulses.

Typical dye-receptive compositions are thermoplastic polymers with softening temperatures below the temperatures used during printing. Although the printing pulses are so short, they can be sufficient to cause a degree of melt bonding between the dyecoat and receiver coat, the result being total transfer to the receiver of whole areas of the dyecoat. The amount can vary from just a few pixels wide, to the two sheets being welded together over the whole print area.

To overcome this particular problem there have been various proposals for adding release agents to the receiver coat. Particularly effective systems include crosslinkable silicones and crosslinking agents, which can be incorporated into the receiver coating composition containing the dye-receptive material, crosslinking being effected after the composition has been coated onto the substrate to form the receiver coat.

Unfortunately, release agents and antistatic agents both act at the surface of the receiver and compete with each other when used together. Thus when a receiver coat containing both additives has sufficient antistatic agent to remove the static problem, total transfer is no longer prevented; and when total transfer is avoided, the handling tends to suffer. However, we have now developed a new receiver sheet construction in which static build up on the receiver coat can be avoided, whether or not that receiver coat contains effective amounts of release agent.

According to a first aspect of the present invention, a receiver sheet for dye-diffusion thermal transfer printing, which comprises a sheet-like dielectric substrate supporting on one side a receiver coat comprising a dye-receptive polymer composition, is characterised in having an antistatic treatment on both sides of the substrate, and in that the antistatic treatment on the side supporting the receiver coat comprises a conductive undercoat located between the substrate and the receiver coat.

We find that despite having an overlying dielectric layer in the form of the thermoplastic polymer of the receiver coat, the effect of the conducting undercoat is to reduce significantly the resistivity at the surface. The conductivity of the surface of a receiver coat overlying a conductive undercoat is indeed less than that of the conductive undercoat itself, as might be expected, but we have found that the resulting exposed surface of the receiver coat can be sufficiently conducting in practice to provide an effective solution to static-induced handling problems.

Moreover, when using receiver coat compositions containing release agents whose effect was sufficiently reduced by introducing conventional antistatic agents to lead to the total transfer problems described above, we have now found that replacing the antistatic agents in the receiver coat by an effective conducting undercoat beneath that receiver coat, also enabled the release agents to remove the total transfer problems.

The conductive sublayer may also contain other ingredients for other purposes, e.g. to improve the coating characteristics of the undercoat precursor composition, to improve the mechanical properties of the undercoat, or to modify the hygroscopic properties for use under humid conditions.

A further advantage we have found is that conducting sublayers can be made transparent and substantially colourless, and thus be suitable for use in transparencies for overhead projection, for example, in addition to normal prints such as those veiwed by reflected light. Most and possibly all of those compositions described hereinafter, when used in suitable thicknesses, e.g. 1 μm, will produce such characteristics.

Various other layers of applied coatings may also be present. For example, the substrate may be provided with an adhesive subbing layer, this being common practice in film coating applications. However we find that a conducting subcoat with curing conditions compatible with those of the receiver coat (as described in more detail hereinafter), itself provides a usefully strong bond between the receiver coat and substrate, even when used directly in contact with the substrate without any of the normal subbing layers being present.

Receiver sheets may also have at least one backcoat on the side of the substrate remote from the receiver coat. Backcoats may provide a balance for the receiver coat, to reduce curl during temperature of humidity changes. They can also have several specific functions, including improvements in handling and writing characteristics, and various examples of backcoats are to be found in the literature of the art. Unlike the receiver coat, however, introduction of antistatic agents into the backcoat does not usually interfere with backcoat functions, and we prefer to incorporate them in the backcoat itself. It can, however, be similarly effective to have a conductive undercoat located between the backcoat and the substrate.

Conductive undercoats of the present invention can provide benefit for a variety of receivers having dielectric substrates. It is particularly beneficial where the substrate is a sheet of thermoplastic film. It can also usefully be employed on synthetic paper, and some cellulosic papers for which static build-up might present handling problems. Laminates can also benefit from the same treatment where the laminate comprises a plurality of sheets at least one of which is formed of a thermoplastic material.

We have found that a particularly effective conductive undercoat comprises an organic polymer containing a plurality of ether linkages doped with an alkali metal salt to provide conductivity. The conductivity can be increased steadily by increasing the amount of alkali metal, up to an amount equivalent to the number of ether linkages with which they are believed to become coordinated. However, this leads to increasing hygroscopic properties, and we prefer to use as little alkali metal salt as will provide adequate conduction. We find that the alkali metals of lower atomic number are the most efficacious, and accordingly prefer to use lithium salts.

Lithium salts of organic acids are particularly preferred, although we have also had some good results using lithium nitrate or lithium thiocyanate.

Our preferred organic polymer comprises at least one compound containing at least one ether linkage per molecule, and a linking agent reactive with the said compound other than with the ether linkage, the sum of the mutually reactive functionalities of the said compound and the linking agent being at least 4. Particularly preferred polymers are cross-linked. These may be provided by adding a further polyfunctional compound reactive with the linking agent and/or the ether-containing compound. We prefer, however, that of the linking agent and ether-containing compound, one has a functionality of at least 2 and the other has a functionality of at least 3.

Particularly preferred organic polymers are acid catalysed reaction products of polyalkylene glycols with a polyfunctional cross-linking agent reactive with the terminal hydroxyls of the polyalkylene glycols. Preferred crosslinking agents are polyfunctional N-(alkoxymethyl) amino resins reactive with such terminal hydroxyls under acid catalysed conditions. Examples include alkoxymethyl derivatives of urea, guanamine and melamine resins. Lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards. Examples of the latter which are sold by American Cyanamid in different grades under the trade name Cymel, are the hexamthoxymethylmelamines, suitably used in a partially prepolymerised (oligomer) form to obtain appropriate viscosities. Hexamethoxymethylmelamines are 3–6 functions, depending on the steric hindrance from substituents and are capable of forming highly cross-linked materials using suitable acid catalysts, e.g. p-toluene sulphonic acid (PTSA).

Our preferred polyalkylene glycols are polyethylene glycols. We have also obtained useful results with polypropylene glycols, but as the series progresses, the moisture resistance is reduced and the strength of the normally very thin conductive coating decreases. Polyethylene glycols are readily available in molecular weights up to about 10,000 (weight average), perhaps higher, but for the present application we prefer to limit it to 2,000 to maintain a high level of cross-linking relative to the number of ether sites for coordination of the alkali metal salts. To some extent this ratio controls the hygroscopic properties of the undercoat, the more highly cross-linked materials being preferred for use in particularly humid conditions. Suitable low molecular weight polyethylene glycols include diethylene glycol and triethylene glycol.

Receiver sheets according to the first aspect of the invention can be sold and used in the configuration of long strips packaged in a cassette, or cut into individual print size portions, or otherwise adapted to suit the requirements of whatever printer they are to be used with, whether or not this incorporates a thermal print head to take full advantage of the properties provided hereby.

According to a second aspect of the invention, we provide a stack of print size portions of a receiver sheet according to the first aspect of the invention, packaged for use in a thermal transfer printer. This has particular advantage in that the conductive layer of the present invention enables the sheets to be fed individually from the stack to a printing station in a printer, unhindered by static-induced blocking. There is also less risk of dust pick-up.

A preferred receiver sheet is one wherein the receiver coat comprises a dye-receptive polymer doped with a release system, the latter comprising at least one hydroxy polyfunctional silicone cross-linked by at least one polyfunctional N-(alkoxymethyl) amine resin reactive with such functional hydroxyls of the silicones under acid catalysed conditions. Examples of the amino resins include those specified above for the conducting undercoat, such as the Cymel hexamethoxymethylmelamines. We particularly prefer that the cross-linking agent used in the receiver coat be essentially the same as the linking agent of the conductive undercoat. By "essentially the same" we have in mind that a different grade of Cymel may be desirable to adjust the viscosity during coating, for example, while retaining essentially the same chemical characteristics. A further difference is that for the receiver coat, the acid catalysts are preferably blocked when first added, to extend the shelf life of the coating composition; examples include amine-blocked PTSA (e.g. Nacure 2530) and ammonium tosylate.

The release system is cured after it has been added to the dye-receptive polymer composition, and applied as a coating onto the pre-formed conductive undercoat. Use of a release system that is acid catalysed, like the undercoat, leads to compatibility between the two layers, and we find that even though curing of the conductive undercoat should be complete before the receiver layer is superimposed, we obtain a stronger bond between them than when we use silicone release agents cross-linked under different, less compatible, conditions.

Figure 2:
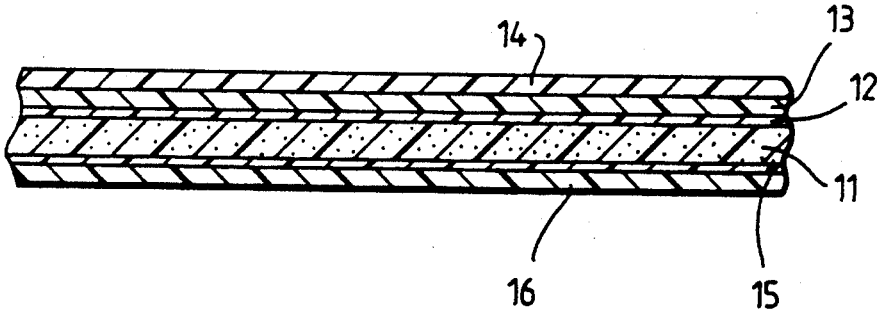

The invention is illustrated by reference to specific embodiments shown in the accompanying drawings, in which:

FIG. 1 is a diagrammatical representation of a cross section through a receiver according to the present invention, and FIG. 2 is a diagrammatical representation of a cross section through a second receiver according to the present invention.

The receiver sheet shown in FIG. 1 has a substrate of biaxially orientated polyethyleneterephthalate film 1. Coated onto one side of this is a conducting undercoat 2 of the present invention, overlain by a receiver coat 3. On the reverse side is an antistatic backcoat 4.

The receiver sheet shown in FIG. 2 uses synthetic paper 11 for the substrate. This has a subbing layer 12, conducting undercoat 13, and receiver coat 14, and on the reverse side is a further subbing layer 15 and a backcoat 16.

To illustrate the efficacy of the present invention, a series of receiver sheets were prepared essentially as shown in FIG. 1, with various conductive undercoats according to the invention. The compositions used are showing the table below. Their surface resistivities were measured on the receptive side of the receiver sheet at two stages; firstly after application, drying and curing (at 110° C.) of the conducting undercoat (i.e. before overlaying this with the receiver coat), and then to provide an evaluation of the undercoat in the finished receiver sheet, the surface resistivity of the receiver coat itself was measured. The measurement conditions in each case were 20° C. and 50% humidity.

The receiver coat used in Examples 1–22 was prepared from the following solutions, where the quantities are quoted as parts by weight:

| | | |
|---|---|---|
| A. | 12 pts | Vitel PE200 (saturated polyester) |
| | 0.60 pts | Atlac 363E (unsaturated polyester) |
| | 0.51 pts | aminosiloxane M468 (release agent) |
| | 53 pts | toluene |
| | 36 pts | MEK |
| B. | 0.12 pts | Imidrol OC |
| | 0.09 pts | stearic acid |
| | 4.4 pts | toluene |
| | 4.4 pts | MEK |
| C. | 0.09 pts | Degacure K126 |
| | 2.2 pts | toluene |

Solutions A and B were prepared separately and filtered, and the catalyst solution C was mixed into the filtered solution shortly before coating. After coating, and curing at 140° C., this receptive coat had a dry thickness of about 2 μm.

The formulations used in each of the conductive undercoats reported in Examples 1–22, and the surface resistivities (where measured) are given in Table 1 below, the percentages quoted being by weight of the composition excluding the acid catalyst, which in Examples 1–6 is quoted as weight % of the Cymel, and in Examples 7–22 as weight % of the total composition. In the Table 1 the following abbreviations and trade names have been used:

PEG is polyethylene glycol,
PPG is polypropylene glycol,
Digol is diethylene glycol
Trigol is triethylene glycol
Cymel is hexamethoxymethylmelamine,
Triflate is lithium trifluoro methane sulphate,
KFBS is potassium nona fluoro-1-butane sulphonate,
PTSA is p-toluene sulphonic acid.

TABLE 1

| Example | composition | surface resistivity Ω/square undercoat | surface resistivity Ω/square receptive layer |
|---|---|---|---|
| 1 | 33% PEG 400<br>50% Cymel 300<br>17% Triflate<br>+10% PTSA | $7 \times 10^7$ | $6 \times 10^9$ |
| 2 | 35% PEG 400<br>52% Cymel 300<br>13% Triflate<br>+10% PTSA | $1 \times 10^8$ | $2 \times 10^9$ |
| 3 | 40% PEG 400 | $2 \times 10^7$ | $3 \times 10^9$ |

TABLE 1-continued

| Example | composition | surface resistivity Ω/square undercoat | receptive layer |
|---|---|---|---|
| | 40% Cymel 300<br>20% Triflate<br>+10% PTSA | | |
| 4 | 43% PEG 400<br>36% Cymel 300<br>20% Triflate<br>+10% PTSA | $1.5 \times 10^7$ | $8 \times 10^9$ |
| 5 | 50% PEG 400<br>41% Cymel 300<br>9% Triflate<br>+10% PTSA | | |
| 6 | 39% PEG 400<br>32% Cymel 300<br>29% Triflate<br>+10% PTSA | | |
| 7 | 39% PEG 400<br>44% Cymel 300<br>17% LiSCN<br>+1% PTSA | | |
| 8 | 39% PEG 400<br>44% Cymel 300<br>17% LiSCN<br>+5% phthalic acid | | |
| 9 | 42% PEG 1500<br>39% Cymel 300<br>19% Triflate<br>+5% phthalic acid | | |
| 10 | 42% PEG 4000<br>39% Cymel 300<br>19% Triflate<br>+5% Phthalic acid | | |
| 11 | 37% PPG<br>37% Cymel 303<br>26% Triflate<br>+5% phthalic acid | $7 \times 10^8$ | |
| 12 | 37% PEG 400<br>37% Cymel 303<br>26% Triflate<br>+5% phthalic acid | $3 \times 10^7$ | |
| 13 | 35% PEG 400<br>35% Cymel 303<br>30% Triflate<br>+5% phthalic acid | $6 \times 10^7$ | $4 \times 10^9$ |
| 14 | 37.5% PEG 40<br>31% Cymel 303<br>31.5% Triflate<br>+5% phthalic acid | $4 \times 10^7$ | $3 \times 10^9$ |
| 15 | 20% PEG 400<br>29% Cymel 303<br>60% Triflate<br>+5% phthalic acid | $4 \times 10^6$ | |
| 16 | 21% PEG 200<br>31% Cymel 303<br>48% Triflate<br>+5% phthalic acid | $6 \times 10^6$ | |
| 17 | 24% PEG 200<br>40% Cymel 303<br>36% KSCN<br>+5% phthalic acid | $7 \times 10^6$ | |
| 18 | 21% Trigol<br>38% Cymel 303<br>41% Triflate<br>+5% phthalic acid | $1 \times 10^6$ | |
| 19 | 20% Digol<br>51% Cymel 303<br>29% Triflate<br>+5% phthalic acid | $3 \times 10^7$ | |
| 20 | 18% digol<br>47% Cymel 303<br>35% KFBS<br>+5% phthalic acid | $2 \times 10^{10}$ | |
| 21 | 21% Digol<br>55% Cymel 303<br>24% $LiNO_3$<br>+5% phthalic acid | $2 \times 10^6$ | |
| 22 | 19% Trigol<br>35% Cymel 303<br>46% Li PTSA<br>+5% PTSA | $2 \times 10^7$ | |

In Examples 1, 2, 3, 4, 13 and 14, good coatings were obtained of the receiver coat overlying the undercoat. Thermal transfer prints were made using standard dyesheets, and no total transfer was observed. All such receiver sheets handled well, both before and after printing.

EXAMPLE 23

The above experiments were repeated using a different receiver coat. The conductive undercoat comprised Cymel 303 (1.51 pts by wt), diethylene glycol (0.57 pts), Lithium PTSA (0.57 pts), and PTSA (0.19). The receiver coat also used Cymel 303, and the coating solution was made (as before) by mixing three solution, these being:

| | | |
|---|---|---|
| A. | 14.8 pts | Vylon 200 |
| | 0.15 pts | Tinuvin 234 |
| | 60 pts | toluene |
| | 35 pts | MEK |
| B. | 0.12 pts | Cymel |
| | 2.5 pts | MEK |
| C. | 0.024 pts | Tegomer H-Si 2210 |
| | 0.15 pts | Nacure 2530 |
| | 2.5 pts | MEK |

(Tegomer HSI 2210 is a hydroxy organo functional polydimethylsiloxane)

Again a receiver sheet was obtained having good handling properties. The receiver coat of this example appeared to have a stronger bond to the conductive undercoat than those of the previous examples.

EXAMPLE 24

To illustrate further the present invention, receiver sheets were prepared essentially as shown in FIG. 1. A large web of transparent biaxially orientated polyester film was provided on one side with a conductive undercoat overlayed with a receiver coat, and with a conductive backcoat on the other, as described below.

The first coat to be applied to the web was the backcoat. One surface of the web was first chemically etched to give a mechanical key. A coating composition was prepared as follows:

| | |
|---|---|
| acetone/ diacetone alcohol | 11/1 mixed solvent with trace of isopropanol |
| VROH | 42 parts by weight |
| Cymel 303 | 15 parts by weight |
| Nacure 2530 | 10 parts by weight |
| $LiNO_3$ | 1 parts by weight |
| Diakon MG102 | 22 parts by weight |
| Gasil EBN | 2 parts by weight |
| Syloid 244 | 8 parts by weight |

(VROH is a solvent-soluble terpolymer of vinyl acetate, vinyl chloride and vinyl alcohol sold by Union Carbide, Gasil EBN and Syloid 244 are brands of silica particles sold by Crosfield and Grace respectively, and Diakon MG102 is a polymethylmethacrylate sold by ICI).

The backcoat composition was prepared as three solutions, these being thermoset precursor, antistatic solution and filler dispersion. Shortly before use, the three solutions were mixed to give the above composition. This was then machine coated onto the etched surface, dried and cured to form a 1.5–2 μm thick backcoat.

For the receiver side of the substrate, a conductive undercoat composition was prepared consisting of:

| | |
|---|---|
| methanol | (solvent) |
| PVP K90 | 20 parts by weight |
| Cymel 303 | 40 parts by weight |
| K-Flex 188 | 5 parts by weight |
| Digol | 15 parts by weight |
| PTSA | 20 parts by weight |
| $LiOH.H_2O$ | 3.2 parts by weight |

(K-Flex is a polyester polyol sold by King Industries and PVP is polyvinyl pyrrolidone, both being added to adjust the coating properties.)

This composition was prepared initially as three separate solutions of the reactive ingredients, and mixing these shortly before use. This composition was machine coated onto the opposite side of the substrate from the backcoat, dried and cured to give a dry coat thickness of about 1 μm.

The receiver layer coating composition also used Cymel 303 and an acid catalysed system compatible with the conductive undercoat, and consisted of:

| | |
|---|---|
| toluene/MEK | 60/40 solvent mixture |
| Vylon 200 | 100 parts by weight |
| Tegomer H-Si 2210 | 1.3 parts by weight |
| Cymel 303 | 1.8 parts by weight |
| Tinuvin 900 | 2.0 parts by weight |
| Nacure 2530 | 0.2 parts by weight |

(Tegomer H-Si 2210 is a bis-hydroxyalkyl polydimethyl-siloxane, cross-linkable by the Cymel 303 under acid conditions to provide a release system effective during printing, being sold by Th Goldschmidt.)

This coating composition was made (as before) by mixing three functional solutions, one containing the dye-receptive Vylon and the Tinuvin UV absorber, a second containing the Cymel cross linking agent, and the third containing both the Tegomer silicone release agent and the Nacure solution to catalyse the crosslinking polymerisation between the Tegomer and Cymel materials. Using in-line machine coating, the receiver composition was coated onto the conductive undercoat, dried and cured to give a dye-receptive layer about 4 μm thick.

Examination of the coated web showed that the highly cross-linked backcoat had proved stable to the solvents and elevated temperatures used during the subsequent provision of the other two coatings. The web of coated film was then chopped into individual receiver sheets, and stacked and packaged for use in a thermal transfer printer. During these handling trials, and during normal printing, the sheets were found to side easily, one over another, and to feed through the printer without any observed misfeeding of the sheet. The receiver sheets were clear and transparent before printing, which properties were retained during printing to give high quality transparencies for overhead projection, with no evidence of total transfer having occurred during printing.

The surface resistivities were measured on both sides of the receiver sheet, at 20° C. and 50% humidity. Values of about $1\times10^{11}$ Ω/square were obtained on the backcoat, and values of about $1\times10^{12}$ Ω/square on the surface of the receiver coat.

EXAMPLE 25

The above Example was repeated using an opaque white substrate of Melinex 990 biaxially orientated polyester film (ICI). A backcoat was first applied followed by a conductive undercoat, both of these having the same composition as in Example 24. The receiver coat composition was modified, however, this being:

| | |
|---|---|
| toluene/MEK | 60/40 solvent mixture |
| Vylon 200 | 100 parts by weight |
| Tegomer H-Si 2210 | 0.7 parts by weight |
| Cymel 303 | 1.4 parts by weight |
| Tinuvin 900 | 1.0 parts by weight |
| Nacure 2530 | 0.2 parts by weight |

The receiver sheets had the same good handling characteristics as the transparencies of Example 24, and again there was no evidence of any total transfer occurring during printing.

EXAMPLES 26 and 27

Two further receiver sheets were prepared with configurations essentially as shown in FIG. 1, with different receiver coats. One of these (Example 26) had a receiver coat of a preferred composition as described above, containing an acid cured silicone/Cymel release system, while the other (Example 27) has a base cured silicone/epoxide release system.

The conductive undercoat in both cases comprised

| | |
|---|---|
| Cymel 303 | 1.51 parts by weight |
| diethylene glycol | 0.57 parts by weight |
| lithium PTSA | 0.57 parts by weight |
| PTSA | 0.19. parts by weight |

The receptive layer of Example 3 also used Cymel 303 as cross linking agent for the silicone, and the coating solution was made by mixing three solutions as follows:

| | | |
|---|---|---|
| A. | toluene/MEK | 60/35 mixed solvent |
| | Vylon 200 | 14.8 parts by weight |
| | Tinuvin 234 | 0.15 parts by weight |
| B | MEK | 2.5 parts by weight |
| | Cymel 303 | 0.12 parts by weight |
| C. | MEK | 2.5 parts by weight |
| | Tegomer H-Si 2210 | 0.024 parts by weight |
| | Nacure 2530 | 0.15 parts by weight |

For Comparison A, the receiver coat was prepared from the following solutions:

| | | |
|---|---|---|
| A. | toluene/MEK | 53/36 solvent mixture |
| | Vitel PE 200 | 12 parts by weight |
| | Atlac 363E | 0.60 parts by weight |
| | aminosiloxane M468 | 0.51 parts by weight |
| B. | toluene/MEK | 4/4 solvent mixture |
| | Imidrol OC | 0.12 parts by weight |
| | stearic acid | 0.09 parts by weight |
| C. | toluene | 2 parts by weight |
| | Degacure K126 | 0.09 parts by weight |

For each receiver coat composition, solutions A and B were prepared separately and filtered, and the catalyst solution C was mixed into the filtered solution shortly before the coating composition was applied over the conductive undercoat. After coating and curing, the receiver coats had a dry thickness of about 2 μm.

Thermal transfer prints were made using standard dyesheets, and no total transfer was observed. Both receiver sheets handled well, both before and after printing.

The receiver coat of Example 26 appeared to have a stronger bond to the conductive undercoat than that of Example 27.

We claim:

1. A receiver sheet for dye-diffusion thermal transfer printing, which comprises a dielectric substrate supporting on one side a receiver coat comprising a dye-receptive polymer composition, is characterised in having an antistatic coating on both sides of the substrate, and in that the antistatic coating on the side supporting the receiver coat comprises a conductive undercoat located between the substrate and the receiver coat.

2. A receiver sheet as claimed in claim 1, characterised in that the conductive undercoat comprises an organic polymer containing a plurality of ether linkages doped with an alkali metal salt to provide conductivity.

3. A receiver sheet as claimed in claim 2, characterised in that the alkali metal is lithium.

4. A receiver sheet as claimed in claim 3, characterised in that the lithium salts include salts of organic acids.

5. A receiver sheet as claimed in claim 2, characterised in that the organic polymer comprises at least one compound containing at least one ether linkage per molecule, and a linking agent reactive with the said compound other than with the ether linkage, the sum of the mutually reactive functionalities of the said compound and the linking agent being at least 4.

6. A receiver sheet as claimed in claim 5, characterised in that the polymer is cross-linked.

7. A receiver sheet as claimed in claim 5, characterised in that the organic polymer is an acid catalysed reaction product of a polyalkylene glycol and a polyfunctional cross-linking agent reactive with the terminal hydroxyls of the polyalkylene glycol.

8. A receiver sheet as claimed in claim 7, characterised in that the crosslinking agent is hexamethoxymethylmelamine or oligomer thereof.

9. A receiver sheet as claimed in claim 5, characterised in that a cross-linking agent is used in the receiver coat which is essentially the same as the linking agent of the conductive undercoat.

10. A receiver sheet as claimed in claim 1, characterised in that the receiver coat comprises a dye-receptive polymer doped with a release system, the latter comprising at least one hydroxy polyfunctional silicone cross-linked by at least one polyfunctional N-(alkoxymethyl) amine resin reactive with such functional hydroxyls of the silicones under acid catalysed conditions.

11. A receiver sheet as claimed in claim 1 characterised in that the sheet has a backcoat on the reverse side of the substrate, being the side remote from the receiver coat, and in that the antistatic coating on the reverse side comprises a conductive undercoat located between the backcoat and the substrate.

12. A stack of print size portions of a receiver sheet according to any one of the preceding claims, packaged for use in a thermal transfer printer.

* * * * *